US005181279A

United States Patent [19]

Ross

[11] Patent Number: 5,181,279

[45] Date of Patent: Jan. 26, 1993

[54] CUSHIONED HELMET

[76] Inventor: Dale T. Ross, Rd #1, Box 211-B, Coal Center, Pa. 15423

[21] Appl. No.: 797,379

[22] Filed: Nov. 25, 1991

[51] Int. Cl.[5] ..... A42B 3/12

[52] U.S. Cl. ..... 2/413; 2/412; 2/414

[58] Field of Search ..... 2/410, 411, 412, 413, 2/414, 425

[56] References Cited

U.S. PATENT DOCUMENTS

| | | | |
|---|---|---|---|
| 3,462,763 | 8/1969 | Schneider | 2/413 |
| 3,668,704 | 6/1972 | Conroy | 2/413 |
| 3,994,020 | 11/1976 | Villari | 2/413 |
| 4,035,846 | 7/1977 | Jencks | 2/413 |
| 4,038,700 | 8/1977 | Gyory | 2/413 |
| 4,060,855 | 12/1977 | Rappleyea | 2/413 |
| 4,432,099 | 2/1984 | Grick | 2/412 |
| 4,566,137 | 1/1986 | Gooding | 2/413 |
| 4,586,200 | 5/1986 | Poon | 2/413 |
| 4,698,856 | 10/1987 | Arai | 2/425 |
| 4,729,132 | 3/1988 | Fierro | 2/414 |
| 4,821,344 | 4/1989 | Kamata | 2/414 |
| 4,944,044 | 7/1990 | Zarotti | 2/413 |
| 5,083,320 | 1/1992 | Halstead | 2/413 |

FOREIGN PATENT DOCUMENTS

| | | | |
|---|---|---|---|
| 2654051 | 6/1978 | Fed. Rep. of Germany | 2/413 |

*Primary Examiner*—Andrew M. Falik
*Assistant Examiner*—Diana L. Biefeld
*Attorney, Agent, or Firm*—Leon Gilden

[57] ABSTRACT

A cushioned helmet includes an outer shell formed of a generally rigid body construction defining a full-face construction to include a facial opening directed therethrough. The shell includes a cushion outer liner coextensive with an interior surface of the shell, with an inner lining spaced therefrom to define a pneumatic chamber therebetween coextensively directed throughout the interior surface of the shell. A pump bladder is arranged to permit selective pneumatic filling of the pneumatic chamber, with a pressure relief valve arranged to permit selective release of pressurized air relative to the pneumatic chamber and the helmet construction. A modification of the invention includes "U" shaped cushion inserts arranged for positioning within the shell in contiguous communcation with the inner lining to provide for enhanced protection and accommodate various sized configurations of individuals wearing the helmet.

2 Claims, 4 Drawing Sheets

CUSHIONED HELMET

BACKGROUND OF THE INVENTION

1. Field of the Invention

The field of invention relates to helmet construction, and more particularly to a new and improved cushioned helmet to afford protection to individuals utilizing the helmet in various activities.

2. Description of the Prior Art

Helmet construction is widely available for use, and particularly in motorcycle and other racing events, a cushioned helmet construction is required to provide and afford protection to an individual. Such a helmet is available in the prior art and is illustrated in U.S. Pat. No. 4,821,344 to Kamata wherein the helmet is provided with a cushioned liner directed throughout the interior surface of the shell utilizing an opening through a forward portion of the shell to direct air interiorly of the shell for ventilation.

U.S. Pat. No. 4,060,855 to Rapplea sets forth a pad structure formed of a foam material for positioning within a helmet.

U.S. Pat. No. 4,729,132 to Fierro sets forth a sports helmet, including a resilient cushioned lining formed with a pocket, including an air activated heat generating element.

U.S. Pat. No. 4,698,856 to Arai sets forth a ventilated helmet construction formed with a cushioned inner lining.

As such, it may be appreciated that there continues to be a need for a new and improved cushioned helmet as set forth by the instant invention which addresses both the problems of ease of use as well as effectiveness in construction in affording selective pneumatic filling of a pneumatic cavity within the helmet and in this respect, the present invention substantially fulfills this need.

SUMMARY OF THE INVENTION

In view of the foregoing disadvantages inherent in the known types of helmet apparatus now present in the prior art, the present invention provides a cushioned helmet wherein the same provides for a selectively inflated pneumatic bladder contained coextensively throughout an interior surface of the associated shell of the invention. As such, the general purpose of the present invention, which will be described subsequently in greater detail, is to provide a new and improved cushioned helmet which has all the advantages of the prior art helmet apparatus and none of the disadvantages.

To attain this, the present invention provides a cushioned helmet including an outer shell formed of a generally rigid body construction defining a full-face construction to include a facial opening directed therethrough. The shell includes a cushion outer liner coextensive with an interior surface of the shell, with an inner lining spaced therefrom to define a pneumatic chmaber therebetween coextensively directed throughout the interior surface of the shell. A pump bladder is arranged to permit selective pneuamtic filling of the pneumatic chamber, with a pressure relief valve arranged to permit selective release of pressurized air relative to the pneumatic chamber and the helmet construction. A modification of the invention includes "U" shaped cushion inserts arranged for positioning within the shell in contiguous communication with the inner lining to provide for enhanced protection and accommodate various sized configurations of individuals wearing the helmet.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved cushioned helmet which has all the advantages of the prior art helmet apparatus and none of the disadvantages.

It is another object of the present invention to provide a new and improved cushioned helmet which may be easily and efficiently manufactured and marketed.

It is a further object of the present invention to provide a new and improved cushioned helmet which is of a durable and reliable construction.

An even further object of the present invention is to provide a new and improved cushioned helmet which is susceptible of a low cost of manufacture with regard to both materials and labor, and which accordingly is then susceptible of low prices of sale to the consuming public, thereby making such cushioned helmets economically available to the buying public.

Still yet another object of the present invention is to provide a new and improved cushioned helmet which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
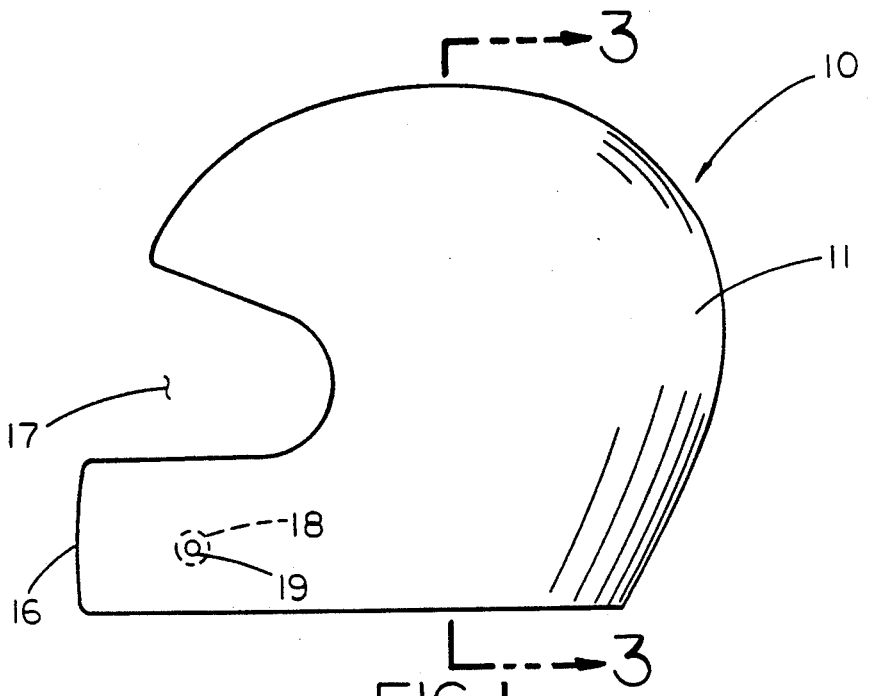
FIG. 1 is an orthographic side view of the instant invention.
Figure 2:
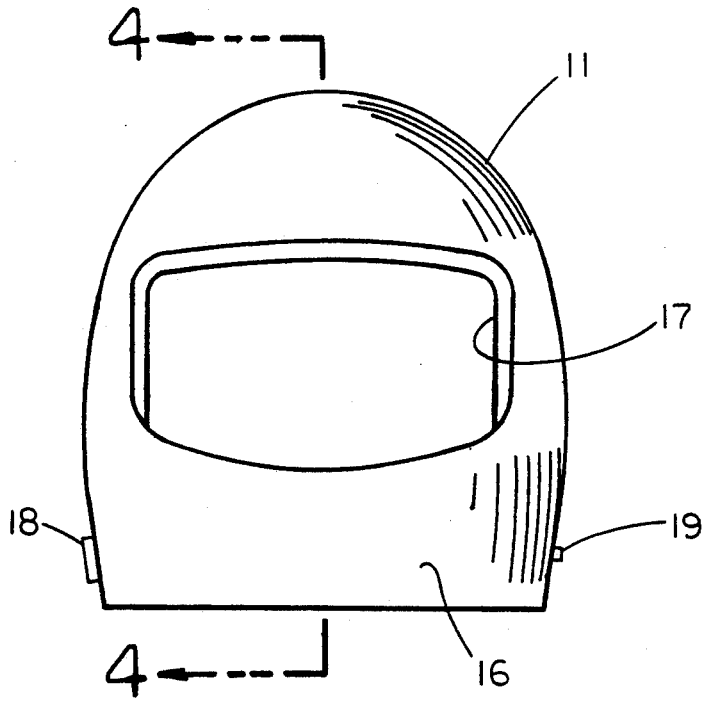
FIG. 2 is an orthographic frontal view of the instant invention.
Figure 3:
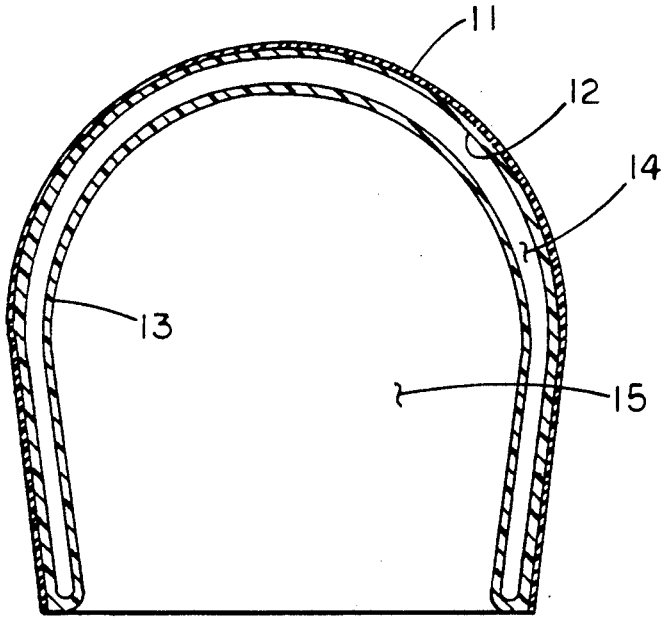
FIG. 3 is an orthographic view, taken along the lines 3—3 of FIG. 1 in the direction indicated by the arrows.
Figure 4:
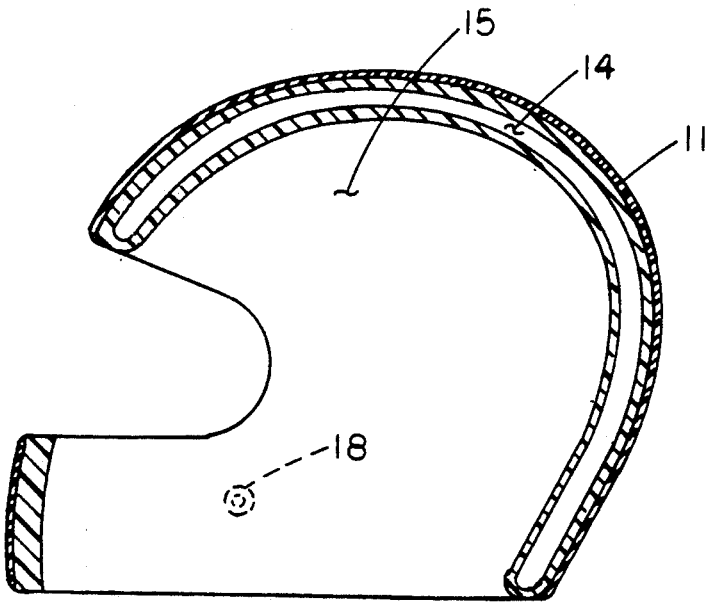
FIG. 4 is an orthographic view, taken along the lines 4—4 of FIG. 1 in the direction indicated by the arrows.

With reference now to the drawings, and in particular to FIGS. 1 to 7 thereof, a new and improved cushioned helmet construction embodying the principles and concepts of the present invention and generally designated by the reference numerals 10 and 10*a* will be described.

More specifically, the cushioned helmet 10 of the instant invention essentially comprises a rigid shell body 11 defining helmet internal shell cavity 15 therewithin, wherein the shell includes a chin shell portion 16 defining a facial opening 17 through the shell utilizing a visor and the like, typically utilized in such helmets (not shown). A cushioned outer lining 12 is mounted in contiguous and coextensive relationship relative to an interior surface of the shell body 11, with an inner lining 13 spaced from the cushioned outer lining 12 defining a pneumatic chamber 14 between the outer lining 12 and the inner lining 14 directed coextensively throughout the interior surface of the shell body 11. The pneumatic chamber 14 is arranged for selective inflation through a pneumatic pump bladder 18 mounted to the shell body 11 projecting through an exterior surface thereof, with a pressure release valve 19 positioned in a diametrically opposed relationship relative to the pump bladder 18 to effect selective pressure release from the pneumatic chamber 14. The pump bladder 18 and the release valve 19 are positioned on opposed sides of the shell 11 to minimize confusion as to the functioning of each component of the pump bladder and release valve, particularly during active use of the helmet.

Figure 5:
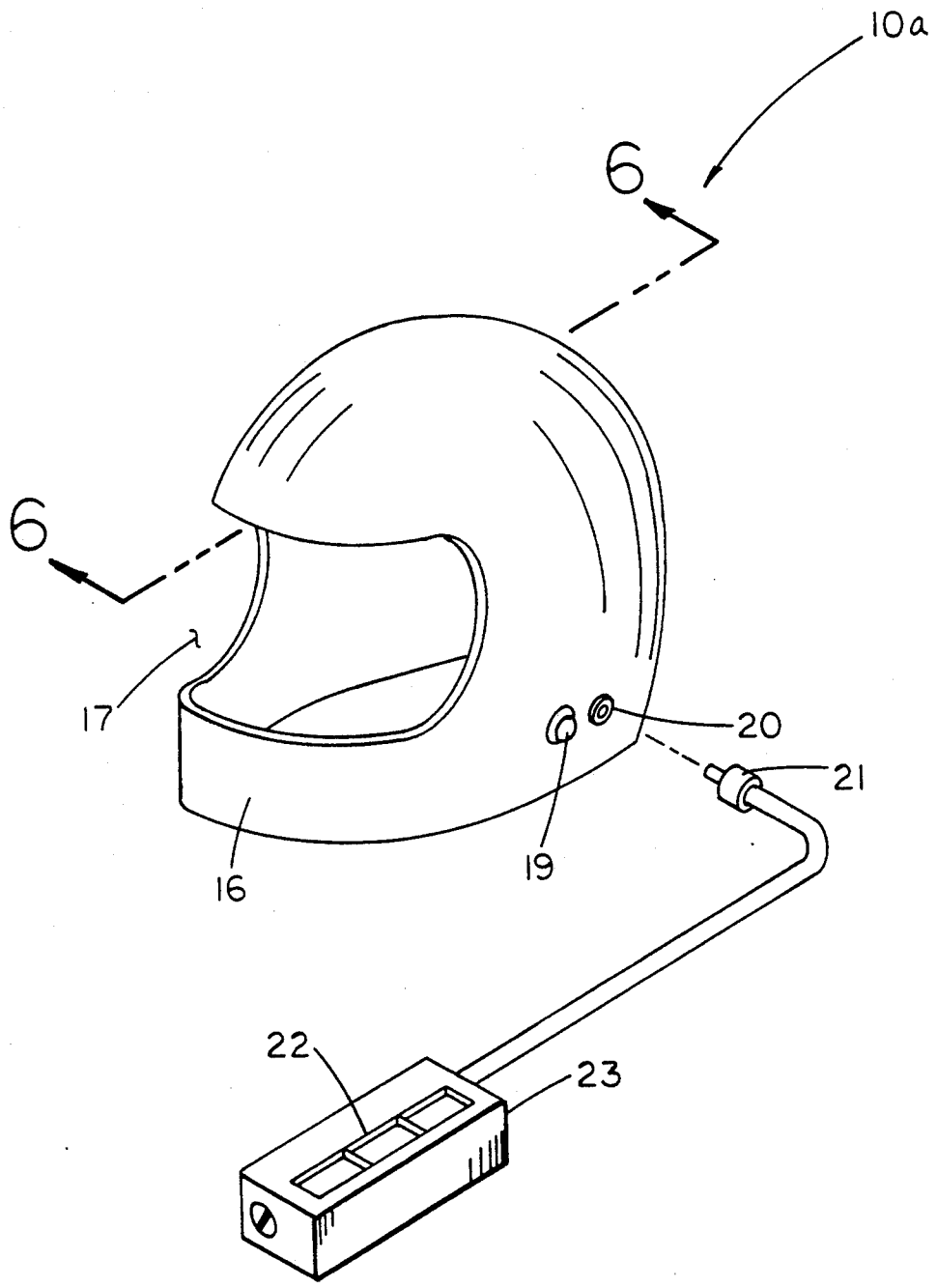
FIG. 5 is an isometric illustration of a modification of the invention.
Figure 6:
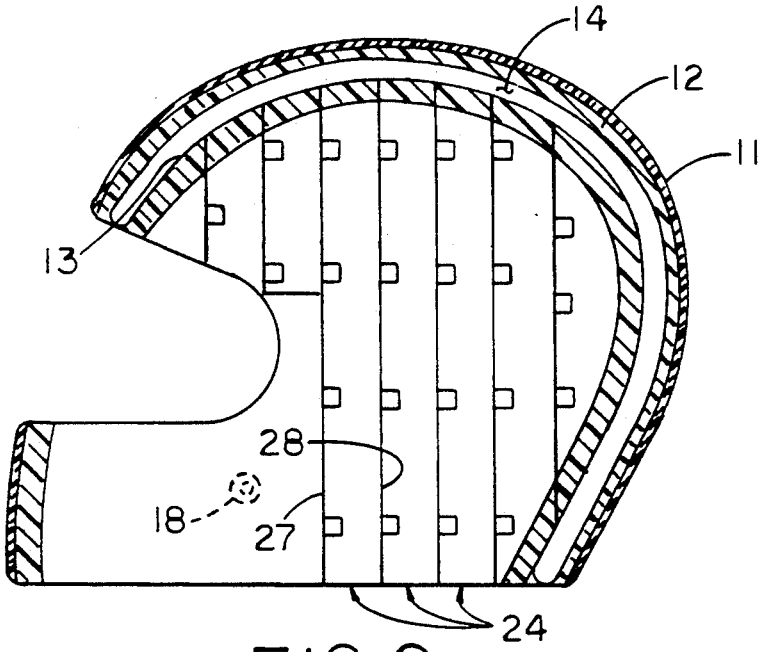
FIG. 6 is an orthographic view, taken along the lines 6—6 of FIG. 5 in the direction indicated by the arrows.
Figure 7:
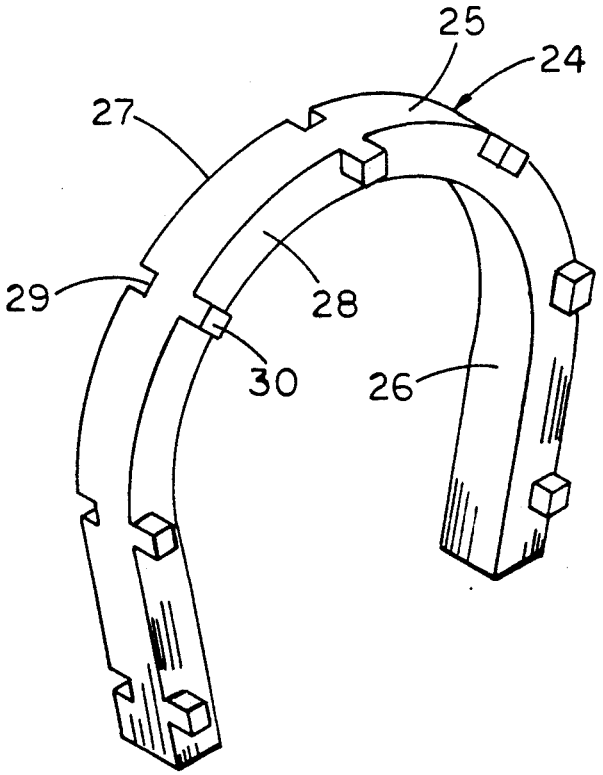
FIG. 7 is an isometric illustration of a "U" shaped cushion insert utilized by the modified helmet construction of the invention.

A modified helmet 10*a* of the invention is illustrated in the FIGS. 5–7 to include a sensor bore 20 directed through the shell 11 into the pneumatic chamber 14 to receive a pressure transducer sensor 21 therewithin that in turn is in communication with a digital display 22 of a display housing 23 to provide for illustration of pressure contained within the pneumatic chamber 14.

Reference to the FIGS. 6 and 7 illustrate the use of a row of "U" shaped cushion inserts 24, with each cushion insert positioned in contiguous communication with the bladder, and more particularly in communication with the inner liner 13. Each "U" shaped insert 24 includes an insert outer arcuate surface for mounting the insert 24 in communication with the inner lining in a complementary relationship, with each insert 24 including an insert inner arcuate surface 26 arranged for receiving an individual head portion. The inserts are formed of a foam compressible material to enhance cushioning in use and accommodate application of the helmet construction to individuals of various head sizes to thereby permit utilization of the single helmet by a plurality of individuals. Each insert 24 includes a first planar side wall 27 formed with first side wall cavities 29 spaced apart a predetermined spacing that cooperate with a plurality of second side wall projections 30, wherein each projection of the second projections 30 are received within an individual side wall cavity 29 of the plurality of side wall cavities of an adjacent insert, wherein the projections 30 are mounted projecting exteriorly of a second side wall 28 that is arranged in a parallel spaced relationship relative to the first side wall 27. In this manner as illustrated in FIG. 6, the inserts may be stacked in a row within the interior surface of the helmet permitting ease of assembly and assembly of the inserts in use.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A cushioned helmet, comprising, a rigid shell body, the rigid shell body including a convex exterior surface and a concave interior surface, with the shell body including a cushioned outer lining coextensive with and in contiguous communication with the interior DB surface, and an inner lining spaced from the outer lining, wherein the inner lining and outer lining define a pneumatic chamber therebetween that is coextensively directed throughout the interior surface, and a pneumatic pump bladder means mounted to the shell body directed exteriorly of the exterior surface thereof for effecting selective pneumatic pressurizing to the pneumatic chamber, and a pressure release valve mounted to a second side of the shell body directed through the exterior surface thereof to effect selective pressure release of the pneumatic chamber, wherein the pump bladder means and the pressure release valve are arranged in diametrically opposed relationship relative to one another, and the shell body further includes a series of insert means for selective mounting and removal relative to the inner lining, and the insert means includes a plurality of "U" shaped cushion inserts arranged in row, wherein each insert includes an insert outer arcuate surface in contiguous communication with the inner lining and an insert inner arcuate surface arranged for accommodation of an individual's head positioned within the shell body, and each insert including a first planar side wall spaced from and parallel to a second planar side wall, the first planar side wall includes a plurality of first side wall cavities spaced apart a predetermined spacing, and the second side wall includes a plurality of second side wall projections spaced apart a spacing equal to the predetermined spacing, wherein the first side wall cavities and the second side wall projections are orthogonally directed relative to the first planar side wall and the second planar side wall, and each first side wall cavity of said plurality of side wall cavities is in alignment with a respective second side wall projection of said plurality of second side wall projections.

2. A helmet as set forth in claim 1 including a sensor bore directed through the shell body in communication with the pneumatic chamber, wherein the sensor bore receives a transducer sensor therewithin, and the transducer sensor is in communication with a visual display for visual indication of pressure utilization of the pneumatic chamber.

* * * * *